US005414441A

United States Patent [19]

Memarzadeh et al.

[11] Patent Number: 5,414,441

[45] Date of Patent: May 9, 1995

[54] TEMPERATURE COMPENSATION APPARATUS FOR LIQUID CRYSTAL DISPLAY

[75] Inventors: Kazem Memarzadeh; Robert L. Protheroe; John F. Crooks, all of Cambridge, Ohio

[73] Assignee: NCR Corporation, Dayton, Ohio

[21] Appl. No.: 726,321

[22] Filed: Jul. 5, 1991

Related U.S. Application Data

[63] Continuation-in-part of Ser. No. 640,189, Jan. 11, 1991, abandoned.

[51] Int. Cl.[6] ..... G09G 3/36

[52] U.S. Cl. ..... 345/87; 345/89; 345/101

[58] Field of Search ..... 340/784 F, 813, 811, 340/793; 359/86; 330/256, 289, 272, 266; 358/174, 236, 169, 170; 345/87, 89, 98, 101

[56] References Cited

U.S. PATENT DOCUMENTS

| | | | |
|---|---|---|---|
| 4,128,311 | 12/1978 | Smith et al. | 359/86 |
| 4,326,171 | 4/1982 | Shaw et al. | 330/256 |
| 4,338,600 | 7/1982 | Leach | 340/812 |
| 4,425,027 | 1/1984 | Portmann | 359/86 |
| 4,687,956 | 8/1987 | Itoh et al. | 340/784 F |
| 4,807,972 | 2/1989 | Klosterboer | 350/331 T |
| 4,919,520 | 4/1990 | Okada et al. | 350/331 T |
| 4,923,285 | 5/1990 | Ogino et al. | 350/331 T |
| 4,945,352 | 7/1990 | Ejiri | 340/805 |
| 4,952,032 | 8/1990 | Inou | 350/350 |

FOREIGN PATENT DOCUMENTS

| | | | |
|---|---|---|---|
| 59-97209 | 6/1984 | Japan | 340/784 F |
| 60-144632 | 7/1985 | Japan | 340/784 F |

*Primary Examiner*—Ulysses Weldon
*Assistant Examiner*—Matthew Luu
*Attorney, Agent, or Firm*—Biebel & French

[57] ABSTRACT

Driving apparatus for a liquid crystal display. The apparatus includes a square wave generator which drives an operational amplifier. The operational amplifier has a pair of parallel feedback paths, one of which is a capacitive feedback path and the other of which is a resistive feedback path. Automatic temperature compensation is provided by incorporating a thermistor in the resistive feedback path. The output signal from the operational amplifier varies in a linear manner with temperature so as to produce an optimal drive for the liquid crystal display.

13 Claims, 2 Drawing Sheets

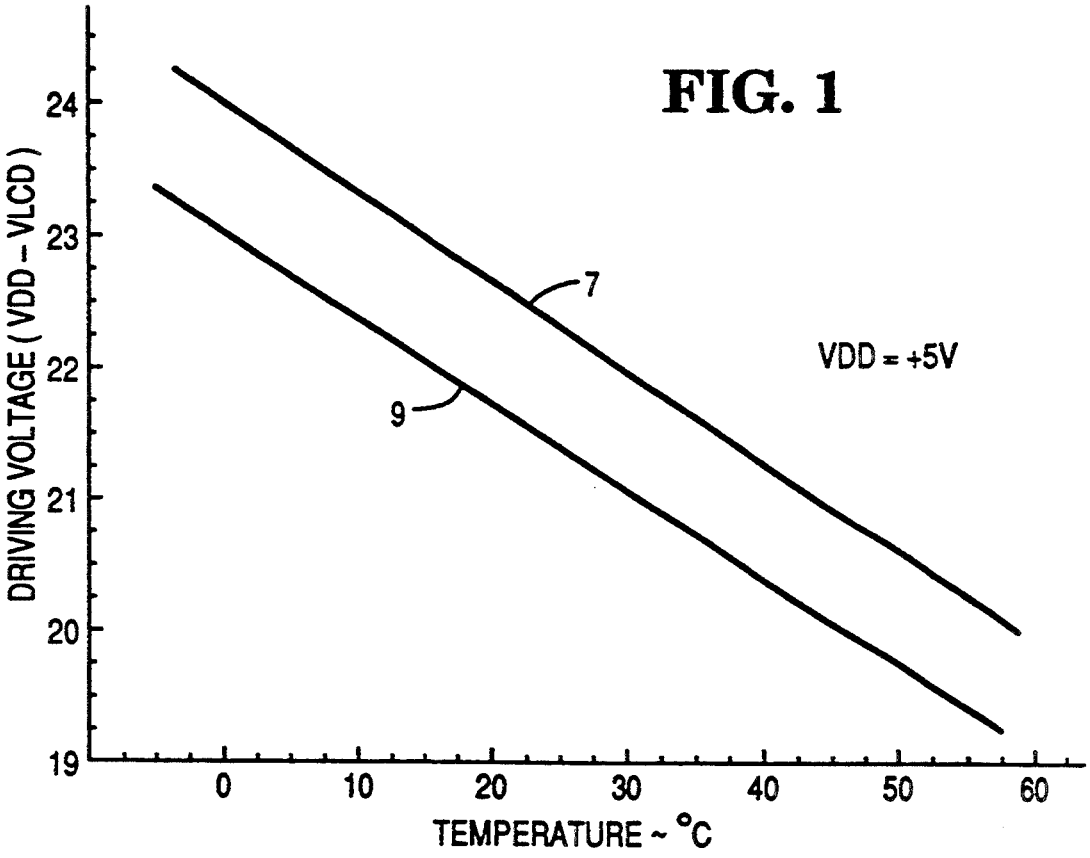
FIG. 2
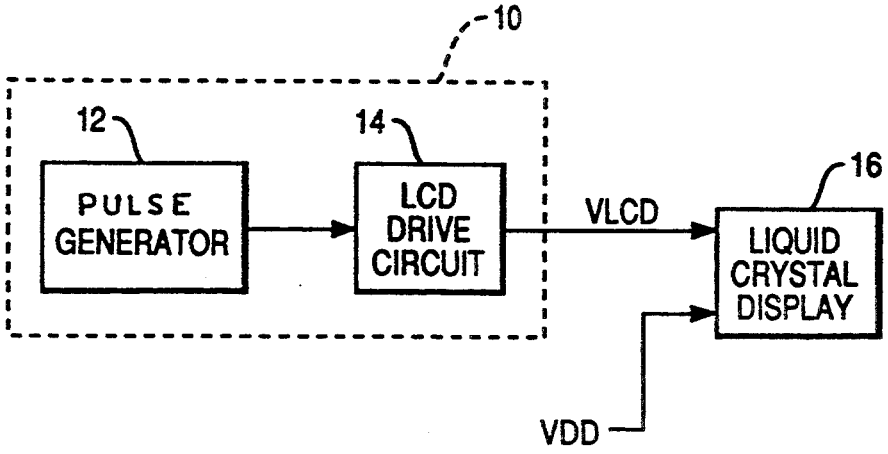

TEMPERATURE COMPENSATION APPARATUS FOR LIQUID CRYSTAL DISPLAY

CROSS REFERENCE TO RELATED APPLICATION

This application is a continuation-in-part of application Ser. No. 07/640,189 filed Jan. 11, 1991, now abandoned.

BACKGROUND OF THE INVENTION

This invention relates to the field of contrast control for liquid crystal displays and more particularly to apparatus for adjusting the contrast control voltage of a liquid crystal display to compensate for ambient temperature effects. Liquid crystal displays are generally driven by a driving voltage VDD-VLCD, where VDD is a supply voltage which is applied uniformly to all cells of the display, and VLCD is a contrast control voltage which is selectively switched only to predetermined cells. In general the visual contrast between a selected cell and a non-selected cell varies with viewing angle, incident lighting level and the level of the driving voltage. For any combination of incident lighting level and viewing angle, there is a driving voltage which produces the optimum contrast. Unfortunately, the optimum driving voltage changes with ambient temperature. This variation of optimal driving voltage with temperature is well known, and numerous schemes have been devised for introducing automatic corrections. However, prior art devices are often times inaccurate. Those which have produced satisfactory accuracy are generally complicated and expensive. There is a need for a simplified and effective device for automatically correcting the driving voltage to a liquid crystal display to compensate for the effect of temperature on the observed contrast.

SUMMARY OF THE INVENTION

This invention provides an apparatus for generating a contrast control voltage for a liquid crystal display which has a temperature dependency matching that of the liquid crystal cells. This results in a driving voltage which produces an optimum observed contrast over a normal range of operating temperatures.

The apparatus comprises a driver, preferably a rectangular wave generator, which may be a programmed microprocessor, and a signal processing circuit including an operational amplifier having a pair of parallel feedback paths. One path is a resistive feedback path and includes a thermistor having a negative temperature coefficient. The inherent nonlinearity of the thermistor may be compensated by use of a shunt resistor in the resistive feedback path. The second feedback path includes a capacitor for averaging the output signal from the operational amplifier. The output from the rectangular wave generator is used as an input for the operational amplifier, and the output from the operational amplifier provides the desired contrast control voltage.

A preferred embodiment of the invention generates a rectangular wave at a nominal frequency of about 23.6 kilohertz with a variable duty cycle of about 50% nominal and converts this rectangular wave into a contrast control voltage which varies with temperature at a rate of about −68 millivolts per °C.

It is therefore a principal object of this invention to provide a contrast control voltage for a liquid crystal display which varies with temperature in a manner which will produce an image on a liquid crystal display having optimum contrast over a range of working temperatures.

Other and further objects and advantages of the invention will be apparent from the following description, the accompanying drawings, and the appended claims.

BRIEF DESCRIPTION OF THE DRAWINGS

FIG. 1 is a plot of required and actual LCD driving voltages over a range of working temperatures.

FIG. 2 is a generalized block diagram of apparatus for generating a contrast control voltage in accordance with this invention.

DESCRIPTION OF THE PREFERRED EMBODIMENT

Figure 3:
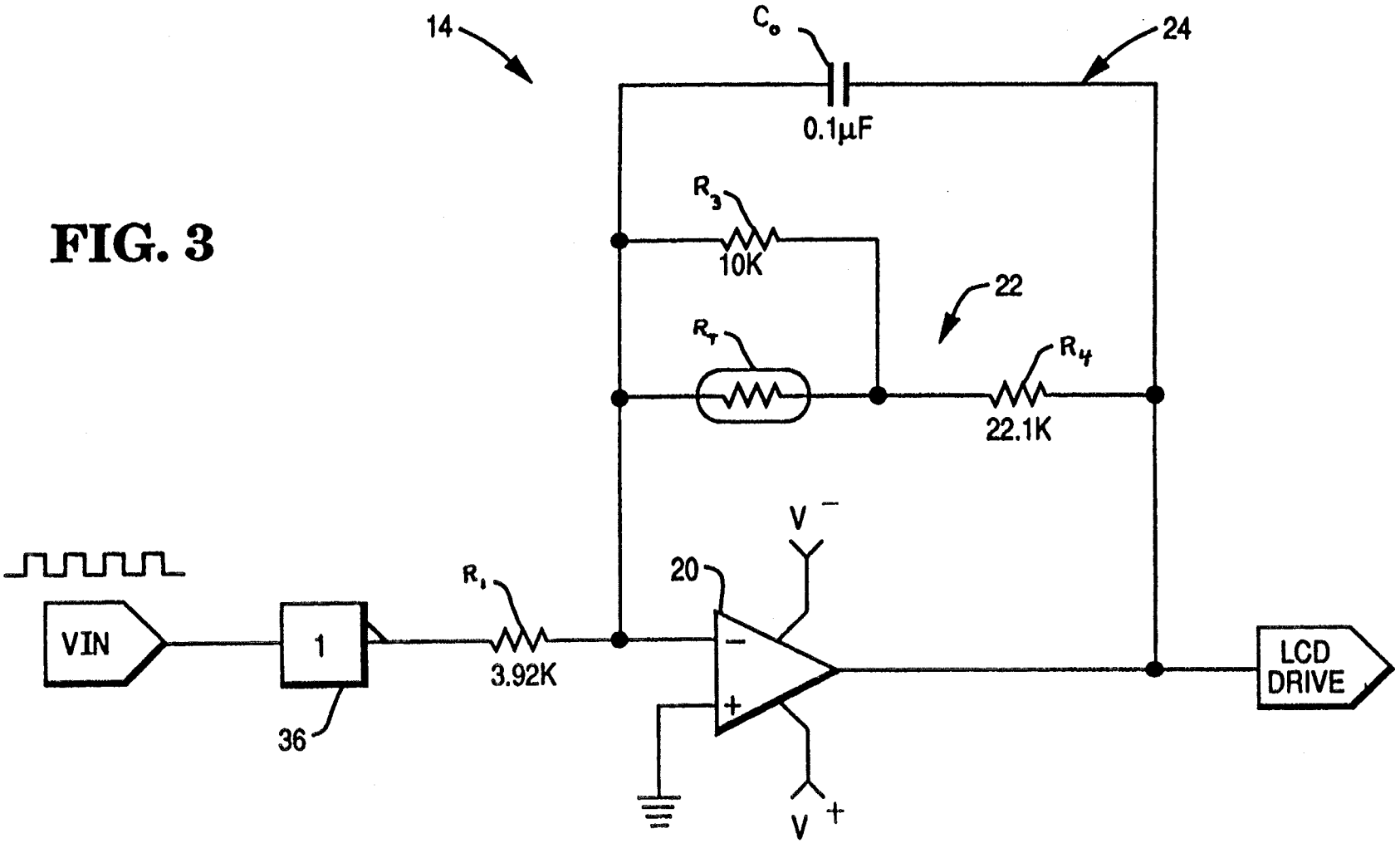
FIG. 3 is a schematic diagram of an electrical circuit for producing a temperature compensated contrast control voltage.

An understanding of the objective of the present invention may be gained by referring to FIG. 1 wherein are illustrated two straight lines 7 and 9. The line 7 represents to a fairly good approximation the driving voltage (VDD-VLCD) required in order to maintain a condition of optimal contrast under typical illumination and viewing angle conditions for a commercially available liquid crystal display. This required voltage decreases fairly linearly with increasing temperature at the rate of about 68 millivolts per °C.

The line 9 approximates the driving voltage obtained from apparatus constructed in accordance with this invention. Line 9 has a negative slope of 65 millivolts per °C. This line is easily shifted upwardly or downwardly as required for driving a selected liquid crystal display under predetermined lighting and viewing conditions. The value of VDD for the plots of FIG. 1 is approximately +5 volts.

Contrast adjustment apparatus in accordance with this invention is illustrated in dotted line form in FIG. 2 as indicated by the reference numeral 10. Apparatus 10 comprises a rectangular wave generator 12 and a signal processing circuit 14. Rectangular wave generator 12 may be any convenient hardware or firmware device. It may also comprise a programmed microprocessor. A programmed microprocessor is preferred, because it readily may be programmed to produce a rectangular wave of any desired duty cycle and at any frequency which is a submultiple of the microprocessor clock frequency. It is contemplated that the rectangular wave output from the generator 12 will have a fixed amplitude (in the order of about 3.5 to 5 volts). Signal processing circuit 14 is designed to accommodate such an input and to respond thereto by producing a temperature compensated contrast control voltage (VLCD) having an average steady state value given by the approximate equation:

$$VLCD(T) = -17.95\ \text{v} + 0.065\ (T - To)\ \text{v}/^{\circ}\text{C};\ To = 25^{\circ}\text{C}.$$

This will produce an LCD driving voltage as illustrated by line 9 of FIG. 1. However, the voltage signal will also have a slight ripple with an amplitude low enough to avoid flickering of liquid crystal display 16.

The liquid crystal display may be any of a variety of commercially available devices. A typical display which has been driven by apparatus according to this invention is an Epson EG7500 LCD array which selectively drives a matrix of 320 by 200 crystal cells. Such an LCD module is suitable for application to point-of-sale terminals such as may be used in supermarkets and the like. These terminals may be arranged for viewing at a fairly constant viewing angle and may have well-controlled incident lighting, so that only temperature-related adjustment is required. When driven by apparatus according to this invention, no manual adjustment is required.

LCD drive circuit 14 may be configured as generally illustrated in FIG. 3. The circuit is basically a lossy integrator built around an operational amplifier 20 having a resistive feedback path 22 and a capacitive feedback path 24. Resistive feedback path 22 incorporates a thermistor RT, manufactured by Keystone Carbon Company, Saint Marys, Pa. 15857 under Part Number RL2005-5536-122D1 to provide the temperature dependency discussed above in connection with FIG. 1. Thermistor RT has a resistance of 10K ohms at 25° C. and a negative temperature coefficient.

The resistance of a thermistor such as thermistor $R_T$ varies nonlinearly with temperature. Therefore, the preferred embodiment of the invention includes a shunt resistor $R_3$. For a thermistor of the type mentioned above, the variation in the resistance of circuit 14 with temperature may be fairly well linearized by use of a shunt resistor $R_3$ having a resistance about equal to the resistance of thermistor $R_T$ at room temperature (the mid-operation range). Shunt resistor $R_3$ and thermistor $R_T$ are in series with another resistor $R_4$ which may have a value of about 22.1K ohms. Capacitive feedback path 24 includes a capacitor $C_0$ which may have a capacitance of about 0.1 microfarads. Capacitive feedback path 24 performs an integration or averaging function, whereas resistive feedback path 22 provides the desired voltage gain. The parallel combination of shunt resistor $R_3$ and thermistor $R_T$ determines the variation of voltage gain with temperature, whereas series resistor $R_4$ provides the proper DC offset.

The time constant of circuit 14 is $R_0C_0$, where $R_0$ is the effective resistance of resistive feedback path 22. The output of circuit 14 to a square wave input is a DC signal with a slight ripple. As the time constant increases, the response time of the circuit increases and the amplitude of the ripple decreases. In general, since rapid temperature variations are not very likely, a relatively large time constant in the order of a few milliseconds is preferable for reducing the flickering of the LCD module 16. The specific circuit described herein has a time constant of about 2.71 milliseconds.

Drive circuit 14 also has an input resistor $R_1$ and a buffer 36. Resistor $R_1$ may have a value of about 3.92K ohms. Buffer 36 assures a consistent signal swing and may be a type 74HC04 device.

An experiment was performed with a circuit configured as illustrated in FIG. 3, and the results of the 5 experiment are tabulated in Table I.

| T (°C.) | VLCD (V) | VDD-VLCD (V) |
|---|---|---|
| −7.4 | −17.93 | 22.93 |
| 2.7 | −17.82 | 22.82 |
| 7.5 | −17.52 | 22.52 |
| 12.8 | −17.10 | 22.10 |
| 17.4 | −16.83 | 21.83 |
| 22.4 | −16.39 | 21.39 |
| 27.3 | −16.12 | 21.12 |
| 32.1 | −15.80 | 20.80 |

-continued

| T (°C.) | VLCD (V) | VDD-VLCD (V) |
|---|---|---|
| 37.2 | −15.46 | 20.46 |
| 41.8 | −15.20 | 20.20 |
| 47.2 | −14.91 | 19.91 |
| 52.0 | −14.68 | 19.68 |

These tabulated results were used to construct line 9 of FIG. 1, as mentioned above. The experimental data were collected using an input square wave having a frequency of 23.6 kilohertz, an amplitude of approximately 5 V and a duty cycle of about 40% for nominal ambient temperatures. The contrast was optimized initially at a fixed temperature by aligning the duty cycle. Then the temperature was varied from below 0° C. to above 50° C. in several steps, and the LCD drive voltage was recorded at each step. The LCD contrast was visually inspected through a glass window on the temperature chamber, and no noticeable change in contrast was observed as the temperature was stabilized after each temperature step.

It can be shown that the ratio of the peak-to-peak ripple to the mean signal value is given by the expression:

$$\frac{r}{V_{ss}} = \frac{1}{D}\left[\left(\frac{e^{-MD}-1}{e^{-M}-1}\right)-\left(\frac{e^{MD}-1}{e^{M}-1}\right)\right]$$

Where:

$$M = \frac{1}{fR_o C_o}$$

An examination of the above equation will show that the ratio of ripple to mean signal increases with decreasing duty cycle. For example, with f=23.6 KHz, $R_0$=27.1K Ω, $R_1$=3.92K Ω and $C_0$=0.1 μf, the ratio increases from 0 to 1.25% as D decreases from 1.0 to 0.2. When f is decreased to 5.9 KHz for the same $R_0$, $R_1$, and $C_0$, the ratio drops to 1.25% for a duty cycle of 0.8. It is preferred in accordance with the practice of this invention that the ratio of ripple to mean signal not be greater than about 1.25%, especially at lower pulse frequencies.

As noted above, the output from signal processing circuit 14 is a DC signal with a slight ripple. The mean value (DC level) is given by the expression:

$$V_{ss} = V_m \; D \; \frac{R_0}{R_1}$$

where:

$V_m$ is the hi value of the rectangular wave voltage

D is the duty cycle (pulse length divided by the cycle length)

$$R_0 = R_4 + \frac{R_3 * R_T}{R_3 + R_T}$$

The ripple has the general shape of a sawtooth wave at a frequency equal to the frequency of the rectangular wave driving signal. The peak-to-peak magnitude swing of the ripple is a function of the duty cycle, the rectangular wave frequency and the time constant of processing circuit 14.

It will be appreciated that pulsed signals in accordance with this invention need not have a rectangular wave shape that other wave shapes may be used. However, the same duty cycle considerations apply, with the understanding that D is the duty cycle of an equivalent rectangular wave; that is $$D = \overset{f}{V_p}\int_0^{1/f} V(t)\,dt$$

where:

V(t) is the time varying voltage f is the frequency of the pulses $V_p$ is the peak value of the pulses It will be understood, therefore, that the present invention contemplates a signal processing circuit which generates a temperature compensated contrast voltage for an LCD in response to a periodically pulsed drive signal which, as a special case, may be a continuous signal of constant voltage. However, the circuit of this invention is particularly well adapted for use with a microprocessor, which is easily programmed to vary the duty of the drive signal upon demand.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. Apparatus for generating a contrast control voltage for a liquid crystal display comprising:

a driver for generating a periodically pulsed driving signal;

an output terminal for supplying said contrast control voltage to a liquid crystal display;

an operational amplifier having an input side connected for receiving said periodically pulsed driving signal from said driver and an output side connected to said output terminal;

a capacitive feedback path connected between said output side and said input side; and a resistive feedback path connected between said output side and said input side;

said resistive feedback path comprising a thermistor for causing said contrast control voltage to vary with temperature in a manner which enables said contrast control voltage to drive a liquid crystal display at substantially different temperatures with no substantial variation in observed contrast.

2. Apparatus according to claim 1 wherein said driver comprises means for generating a periodically pulsed drive signal having a duty cycle D which produces a ratio of peak-to-peak ripple to mean signal which is not greater than about 1.25%.

3. Apparatus according to claim 2 wherein said combination of elements has a time constant of about 2.71 milliseconds.

4. Apparatus according to claim 3 wherein said driver comprises means for generating a square wave at a frequency of about 23.6 khz with a duty cycle of about 0.5.

5. Apparatus according to claim 1 wherein said driver comprises a programmed microprocessor.

6. Apparatus according to claim 1 wherein said resistive feedback path comprises a shunt resistor in parallel with said thermistor and a series resistor series with the parallel combination of said shunt resistor and said thermistor.

7. Apparatus according to claim 6 wherein said shunt resistor has a resistance approximately equal to the resistance of said thermistor at room temperature.

8. Apparatus according to claim 1 wherein said thermistor has a negative temperature coefficient.

9. Apparatus for generating a contrast control voltage for a liquid crystal display comprising;

a microprocessor programmed to generate a rectangular wave driving signal;

an operational amplifier having an input side connected for receiving said rectangular wave driving signal and an output side for supplying said contrast control voltage to a liquid crystal display;

a feedback capacitor connected between said input side and said output side;

a series resistor and a thermistor connected in series therewith; the series combination of said series resistor and said thermistor being connected in parallel with said feedback capacitor;

a shunt resistor connected in parallel with said thermistor; and a gain controlling resistor connected in series with said operational amplifier;

the resistance of said thermistor and said resistors and the capacitance of said capacitor being selected to cause said contrast control voltage to vary with temperature in a manner such that the combination of said contrast control voltage with the contrast level supply voltage provides an optimal driving voltage for a liquid crystal display.

10. Apparatus according to claim 9 wherein said shunt resistor has a resistance approximately equal to the resistance of said thermistor at room temperature.

11. Apparatus according to claim 10 wherein said gain controlling resistor is connected between said microprocessor and said input side.

12. Apparatus according to claim 10 having an RC time constant of about 2.71 milliseconds.

13. Apparatus according to claim 12 wherein said microprocessor is programmed to generate said square wave at a frequency of about 23.6 khz with a duty cycle of about 50 percent.

* * * * *